US009236232B2

(12) United States Patent
Hansen et al.

(10) Patent No.: US 9,236,232 B2
(45) Date of Patent: Jan. 12, 2016

(54) MULTI-BORE CAPILLARY FOR MASS SPECTROMETER

(75) Inventors: Stuart C. Hansen, Palo Alto, CA (US); Gangqiang Li, Palo Alto, CA (US)

(73) Assignee: AGILENT TECHNOLOGIES, INC., Santa Clara, CA (US)

( * ) Notice: Subject to any disclaimer, the term of this patent is extended or adjusted under 35 U.S.C. 154(b) by 1337 days.

(21) Appl. No.: 12/627,372

(22) Filed: Nov. 30, 2009

(65) Prior Publication Data

US 2011/0127422 A1 Jun. 2, 2011

(51) Int. Cl.
*H01J 49/00* (2006.01)
*H01J 49/04* (2006.01)

(52) U.S. Cl.
CPC ..... *H01J 49/0404* (2013.01)

(58) Field of Classification Search
USPC ..... 250/281, 282, 288
See application file for complete search history.

(56) References Cited

U.S. PATENT DOCUMENTS

| | | | | |
|---|---|---|---|---|
| 4,542,293 | A | 9/1985 | Fenn et al. | |
| 4,808,820 | A | 2/1989 | Blau | |
| 5,525,799 | A | 6/1996 | Andresen et al. | |
| 6,107,628 | A | 8/2000 | Smith et al. | |
| 6,803,565 | B2 | 10/2004 | Smith et al. | |
| 7,547,891 | B2 | 6/2009 | Mordehai et al. | |
| 2006/0214102 | A1 * | 9/2006 | Bai et al. | 250/288 |
| 2008/0142698 | A1 * | 6/2008 | Atherton et al. | 250/282 |

* cited by examiner

*Primary Examiner* — Nicole Ippolito
*Assistant Examiner* — Hanway Chang

(57) ABSTRACT

A mass spectrometer system an ion source configured to produce ions and a non-metallic capillary configured to receive at least a portion of the ions from the ion source. The capillary includes an elongated body and multiple bores traversing the elongated body in a longitudinal direction. The bores transport the received ions through the capillary toward a mass analyzer of the mass spectrometer system for detection.

20 Claims, 4 Drawing Sheets

MULTI-BORE CAPILLARY FOR MASS SPECTROMETER

BACKGROUND

Generally, mass spectrometers measure mass-to-charge ratios of ions obtained from analyte samples, enabling identification of the molecular contents of the samples. Mass spectrometers include an ion source for ionizing the samples for subsequent fragmentation, analysis and detection. Different types of inlet devices provide the samples to the ion source for ionization. For example, in a liquid chromatograph mass spectrometer (LCMS), the inlet device is a liquid chromatograph device which provides molecular samples in liquid form, and in a gas chromatograph mass spectrometer (GCMS), the inlet device is a gas chromatograph device which provides molecular samples in gaseous form. Both types of mass spectrometers provide samples at atmospheric pressure. Mass spectrometers require these samples at vacuum pressures via a pressure reduction means.

To accomplish this task, one type of LCMS includes a capillary that is about 18 cm in length and has a central capillary bore of about 0.6 mm in diameter. In an LCMS, for example, the capillary receives ions from a vaporized sample of an effluent stream (e.g., analyte ion vapor) from an ion source, such as an electrospray ionization (ESI) ion source, and transports the received ions through the single capillary bore to an LCMS inlet region. However, the flow rate of ions through the single capillary bore is restricted, in part, by the physical dimensions of the capillary bore.

For example, a capillary bore having small diameter would typically have a lower ion flow rate than a capillary bore having a larger diameter. However, simply increasing the diameter of the capillary bore does not always result in a higher ion flow rate. For example, with respect to a capillary about 18 cm in length, it has been determined that the extraction of ions formed in a sample plume from a liquid chromatograph device is limited by the onset of turbulence and attendant ion losses in the capillary bore when the internal diameter of the capillary bore is increased beyond 0.9 mm, resulting in an actual reduction in the ion flow rate.

Attempts to improve ion flow include providing multiple metal capillaries (e.g., stainless steel), as described, for example, in U.S. Pat. No. 6,803,565 (Smith et al.), issued Oct. 12, 2004. However, metal capillary tubes are electrically conductive. Therefore, the metal capillary tubes are limited with respect to various techniques for attracting ions having different charges, and especially for transporting ions through potential differences in the capillary tubes, such as applying a potential difference across opposite ends of the capillary tubes.

BRIEF DESCRIPTION OF THE DRAWINGS

The illustrative embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

Figure 1:
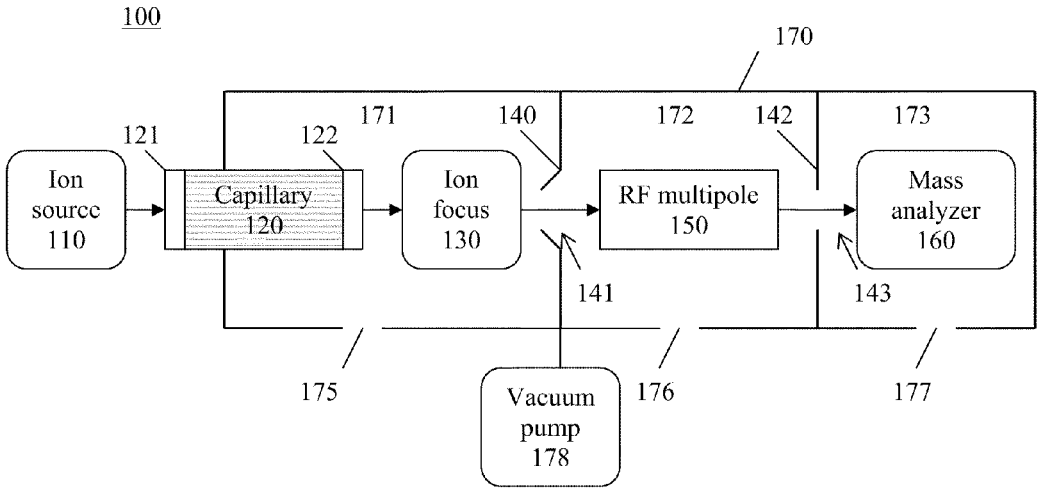
FIG. 1 is a block diagram illustrating mass spectrometer including a multi-bore capillary and skimmer, according to a representative embodiment.

In the following detailed description, for purposes of explanation and not limitation, illustrative embodiments disclosing specific details are set forth in order to provide a thorough understanding of embodiments according to the present teachings. However, it will be apparent to one having had the benefit of the present disclosure that other embodiments according to the present teachings that depart from the specific details disclosed herein remain within the scope of the appended claims. Moreover, descriptions of well-known devices and methods may be omitted so as not to obscure the description of the example embodiments. Such methods and devices are within the scope of the present teachings.

Generally, increased sensitivity of a mass spectrometer improves the limit of detection of analytes of interest. Such increased sensitivity relies, in part, on increasing ion extraction and delivery from the ion source to the mass analyzer of the mass spectrometer. A generally linear relationship exists between ion flow and gas flow through the capillary that transports ions from the ion source. However, as stated above, this relationship of the extraction of ions formed in a sample plume of the ion source is limited, for example, by the onset of turbulence and attendant ion losses in the a capillary bore when the internal diameter of the capillary bore is increased beyond about 0.9 mm (e.g., for an 18 cm capillary). The various embodiments discussed herein enable increased ion flow through the capillary, while keeping internal diameters of the multiple capillary bores small enough to avoid such turbulence and attendant ion losses.

In addition, the capillary body through which the multiple capillary bores are formed is a non-metallic material, such as insulating glass or resistive glass, for example. Accordingly, a difference in electrical potential may be applied to opposite ends of the capillary, e.g., via metalized end portions or bands, on the respective input and output ends of the capillary. The difference in electrical potential provides a change of potential energy of ions when they exit from the multiple capillary bores.

According to various embodiments, a capillary that delivers ions from an ion source to a mass analyzer of a mass spectrometer has multiple bores for transporting higher ion flows without turbulence losses, as well as serving to declust er the ion vapor. The capillary may also be heated to aid the desolvation and declustering action. The multi-bore capillary may be produced and installed using similar processes as a conventional single bore capillary, and therefore can be an efficient and cost-effective upgrade to existing mass spectrometers. For example, a mass spectrometer incorporating embodiments of the multi-bore capillary disclosed herein may use the same high-voltage equipment and software typically is used in conventional mass spectrometers. The pattern of the multiple capillary bores, including the number, layout, sizes and shapes of the bores, can be varied to optimize ion flow based on characteristics of the ion source, such as plume distribution and characteristics of the available vacuum pumping system. The multi-bore capillary may be adjusted in length over a range of a few millimeters to about 20 cm or more, for example, depending on the needs for the attendant high voltage gradient applied to the metalized end portions and consideration of voltage and pressure induced plasma breakdown internally in the bores. Often, a length of about 18 cm is used in a commercial instrument.

FIG. 1 is a block diagram illustrating mass spectrometer system including a multi-bore capillary and skimmer, according to a representative embodiment.

Referring to FIG. 1, mass spectrometer 100 includes ion source 110, capillary 120, ion focusing optics 130, skimmer 140, radio frequency (RF) multipole 150 and mass analyzer 160. Generally, the ion source 110 generates ions from a sample provided by a liquid or gas chromatograph device (not shown). The capillary 120 includes multiple bores (i.e., two or more), which traverse the length of the capillary 120, discussed further below.

Accordingly, ions generated by the ion source 110 are drawn into the multiple capillary bores at an input end of the capillary 120, and pass through the multiple capillary bores to the ion focusing optics 130. By having multiple capillary bores, the flow of ions through the capillary 120 may be increased, since the total area available to ion flow increases, without having to increase the size of any one capillary bore above the threshold that causes turbulence losses of ions to the bore walls of the capillary 120 (e.g., about 0.9 mm for an 18 cm capillary), as discussed above.

In various embodiments, the capillary 120 has a generally elongated shape, having an input end adjacent the ion source 110, an output end adjacent the ion focusing optics 130, and a center longitudinal axis. The capillary 120 may also include first and second conductive (e.g., metal) end portions 121 and 122 on the input and output ends, respectively, for receiving electrical voltages. The first and second conductive end portions 121 and 122 may be formed from nickel-chrome (Nichrome), for example, although other materials may be used in various embodiments. The capillary 120 may be formed of glass, a high temperature polymer, or other compatible non-metal material, that does not conduct electricity (insulating material) or conducts very little electricity (resistive material), such that a difference in electrical potential can be applied across the input and output ends of the capillary 120 via the conductive end portions 121 and 122. The conductive end portions 121 and 122 may be formed on the input and output ends of the capillary 120 by physical vapor deposition, for example, or other compatible technique.

For example, in order to enhance flow of positively charged ions, the input end of the capillary 120 may be negatively charged (e.g., about −4000V) and the output end may be positively charged (e.g., about +200V) to create a negative-to-positive voltage differential, drawing in the positively charged ions. In other words, for positively charged ions, negative and positive voltages are respectively applied to the conductive end portions 121 and 122 to create an electrical polarity including a negative pole at the input end and a positive pole, relative to the input end, at the output end. The received positively charged ions thus have a change in potential energy while being transported through the multiple bores of the capillary 120. Polarities are reversed for negative ions.

When the capillary 120 is formed from glass, it may be insulting glass, such as silicate glass, borosilicate glass (e.g., Pyrex®) or the like, or resistive glass, such as lead silicate material supplied by Photonis, Inc, for example. In various embodiments, when resistive glass is used, the polarity of the input and output ends of the capillary 120 may be rapidly switched, enabling rapid voltage reversal, by applying opposite polarity electrical charges to the metal end portions 121 and 122, respectively. For example, the polarity of the input and output ends of the capillary 120 may be switched at a rate of about 5 to 10 times per second, although other rapid switching rates may be incorporated to provide unique benefits for any particular situation or to meet application specific design requirements of various implementations, as would be apparent to one skilled in the art. The rapid voltage reversal across the capillary 120 enables a positive-ion/negative-ion alternating data collection scheme. Thus, the capillary 120 is able to transport ions over a significant reverse voltage gradient by means of the gas (vapor) flow.

The ion focusing optics 130 focus the beam of ions from the capillary 120 on a nozzle or orifice 141 of the skimmer 140 to further improve transfer efficiency of the ions. The orifice 141 of the skimmer 140 passes or selects a center core of ions to the RF multipole 150, after which the ions pass through orifice 143 of partition 142 to the mass analyzer 160 for detection. The RF multipole 150 may include four, six or eight rods (quadrapole, hexapole or octopole), for example, and the mass analyzer may be of the quadrupole or time-of-flight types.

In an embodiment, a vacuum chamber 170 of the mass spectrometer 100 contains the output end of the capillary 120, the ion focusing optics 130, the RF multipole 150 and the mass analyzer 160. More particularly, the output end of the capillary 120 and the ion focusing optics 130 are located in a first vacuum region 171, the RF multipole 150 is located in a second vacuum region 172 separated from the first vacuum region 171 by the skimmer 140, and the mass analyzer 160 is located in a third vacuum region 173, separated from the second vacuum region 172 by the partition 142.

The skimmer 140 includes the orifice 141 formed in a hollow conical frustum mounted on a conductive wall, which is aligned with the focal point of the ion focusing optics 130. The skimmer 140 serves as a barrier between the first vacuum region 171 and the second vacuum region 172, which are respectively pumped through first port 175 and second port 176 by representative high vacuum pump 178, such as a vane pump, turbomolecular pump or diffusion pump. Similarly, the partition 142 serves as a barrier between the second vacuum region 172 and the third vacuum region 173, which is pumped through third port 177 by the high vacuum pump 178. In an embodiment, the pressure in the second vacuum chamber 172 (e.g., about 10e-3 Torr) is lower than the pressure in the first vacuum chamber 171 (e.g., about 1 Torr) to enhance flow of the ions through the orifice 141 of the skimmer 140 to the RF multipole 150. Likewise, the pressure in the third vacuum chamber 173 (e.g., about 10e-5 Torr) is lower than the pressure in the second vacuum chamber 172 to enhance flow of the ions through the orifice 143 of the partition 142 and to provide appropriate high vacuum for mass analyzer 160. Thus, the capillary 120 is able to transport ions using consecutively applied drops in pressure into and through the vacuum chamber 170, as well as using a significant reverse voltage gradient, discussed above.

An example of a mass spectrometer incorporating a skimmer (such as skimmer 140) is described in U.S. Pat. No. 4,542,293 (Fenn et al.), issued Sep. 17, 1985, the subject matter of which is hereby incorporated by reference. However, the multi-bore capillary according to various embodiments may be included in other types and configurations of mass spectrometers, including mass spectrometers having ion funnels (discussed below with reference to FIG. 4), without departing from the scope of the present teachings.

In an embodiment, the mass spectrometer 100 may be an LCMS and the ion source 110 may be an electrospray ionization (ESI) source, for example, which generates a vapor plume of ions from samples input by a liquid chromatograph device (not shown). That is, the ion source 110 produces an electrically charged jet of vapor from a solution containing the sample and outputs charged droplets (vapor plume) containing the sample ions, as the solution evaporates. The vapor plume is directed past the input end of the capillary 120, typically along a path orthogonal to the direction of flow through the multiple capillary bores. Ions of the vapor plume are drawn through the capillary 120, e.g., based on pressure differential and difference in electrical potential between the conductive end portions 121 and 122 of the input and output ends of the capillary 120.

As discussed above, the capillary 120 has multiple bores traversing its length. According to various embodiments, the capillary 120 is formed of glass or other compatible non-metal material, such as a high temperature polymer, and may have a substantially tubular shape with a center longitudinal axis. In various embodiments, the multiple bores traversing the capillary 120 may likewise have substantially tubular shapes, each of which having a corresponding longitudinal axis that is substantially parallel to the longitudinal axis of the capillary 120 and/or the longitudinal axes of the other bores.

Figure 2:
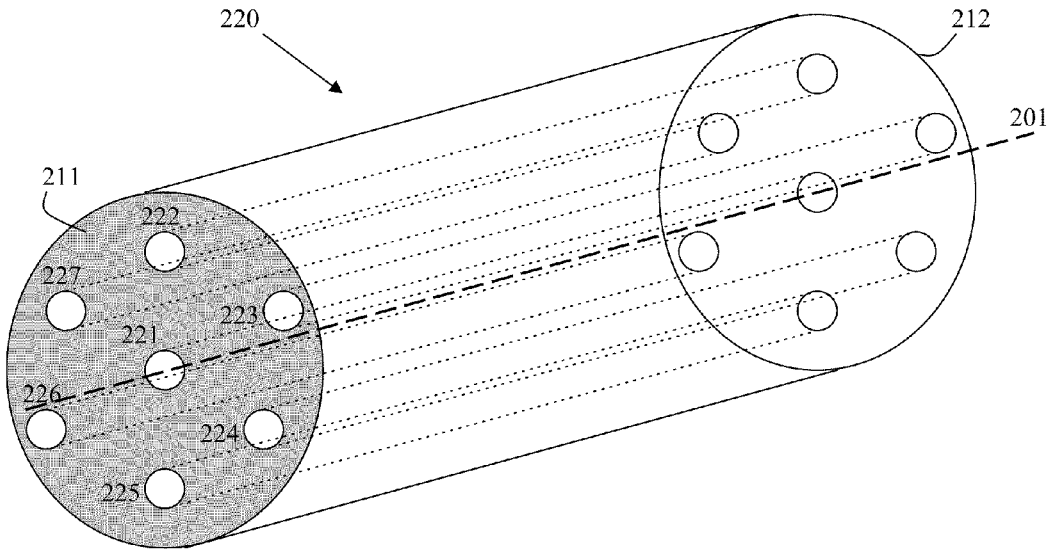
FIG. 2 is a perspective view illustrating a multi-bore capillary of a mass spectrometer, according to a representative embodiment.

For example, FIG. 2 provides a perspective view illustrating a multi-bore capillary of a mass spectrometer, according to a representative embodiment. Referring to FIG. 2, an illustrative capillary 220 includes seven capillary bores 221-227 passing through the entire length of the capillary 220. As shown, a center bore 221 traverses the capillary 220 along its center line, such that the longitudinal axis (not shown) of the center bore 221 is substantially aligned with the longitudinal axis 201 of the capillary 220. The center bore 221 has a substantially circular cross-section, as indicated by the opening on the front face 211 of the capillary 220. Six peripheral bores 222-227 are arranged symmetrically around a perimeter of the front face 211 of the capillary 220. The peripheral bores 222-227 likewise have substantially circular cross sections and longitudinal axes (not shown) that are substantially parallel to one another, as well as to the longitudinal axis 201 of the capillary 220. In the depicted embodiment, the center bore 221 and the peripheral bores 222-227 have equal cross-sectional diameters. Also, the openings on the opposing back face 212 of the capillary 220 corresponding of the bores 221-227 are the same as the corresponding openings on the front face 211. Use of the multi-bore capillary 220, for example, shows about a five times increase in analyte signal levels of a calibration sample (e.g., reserpine).

Notably, the pattern of the bores 221-227, which includes the number, sizes, shapes and arrangement of the bores 221-227, may vary to provide unique benefits for any particular situation or to meet application specific design requirements of various implementations, as would be apparent to one skilled in the art. For example, the pattern of the bores 221-227 may be altered to match a particular vapor plume distribution output by the ion source 110, further discussed below with reference to FIGS. 3A-3E, thus optimizing plume sampling. Also, the length of the capillary 220 may be adjusted to optimize transport efficiency with selected diameters of the bores 221-227.

Numerous variations are possible within the scope of the present teachings. For example, in various embodiments, the bores 221-227 may not be parallel to one another, but rather may diverge from one another or converge toward one another as the bores 221-227 extend through the capillary 220 from the front face 211 to the back face 212. Likewise, the bores 221-227 may have cross-sectional shapes other than circles, such as ovals, squares, rectangles or trapezoidal shapes, for example. Also, the bores 221-227 may have different sizes of cross-sections. For example, in various embodiments, the center bore 221 may have a larger cross-section than each of the peripheral bores 222-227, or the center bore 221 may have a smaller cross-section than each of the peripheral bores 222-227. Similarly, the bores 221-227 may have different shaped cross-sections. For example, in various embodiments, the center bore 221 may have a square cross-section, while each of the peripheral bores 222-227 has circular cross-section.

As stated above with reference to capillary 120, representative capillary 220 may be formed of glass, for example, and the bores 221-227 may be formed through the glass body of the capillary 220 using any technique for fabricating glass, as would be apparent to one skilled in the art, without departing from the scope of the present teachings. For example, the bores may be formed by drawing (pulling) molten glass through a pre-form pattern corresponding to the desired bore pattern. Or, the bores may be formed by drawing a softened perform bundle of larger glass tubes, in proportionate sizes, such that all of the tubes are reduced in diameter and increased in length to reach the final desired dimensions.

As discussed above, when the capillary 120/220 is formed from glass, it may be insulting glass or resistive glass. When resistive glass is used, the polarity of the input and output ends of the capillary 120/220 may be rapidly switched by applying opposite electrical charges to the input and output ends, respectively, via conductive end portions, e.g., conductive end portions 121 and 122 of FIG. 1. For example, in order to enhance flow of negatively charged ions, the input end of the capillary 120/220 may be positively charged and the output end may be negatively charged creating a voltage positive-to-negative differential (e.g., about 4000V), drawing in the negatively charged ions. Likewise, in order to enhance flow of positively charged ions, the input end of the capillary 120/220 may be negatively charged and the output end may be positively charged to create a negative-to-positive voltage differential (e.g., about 4000V), drawing in the positively charged ions. Also, as discussed above, when the capillary 120/220 is formed of resistive glass, rapid voltage reversal is possible, enabling a positive-ion/negative-ion alternating data collection scheme, for example.

FIGS. 3A-3E are cross-sectional views of multi-bore capillaries of mass spectrometers, according to representative embodiments. Each of FIGS. 3A-3E shows a representative pattern in which the multiple capillary bores, e.g., of the capillary 120, may be arranged. As discussed above with reference to FIG. 2, the sizes and shapes of the cross-sections in FIGS. 3A-3E may vary, without departing from the scope of the present teachings.

Figure 3A:
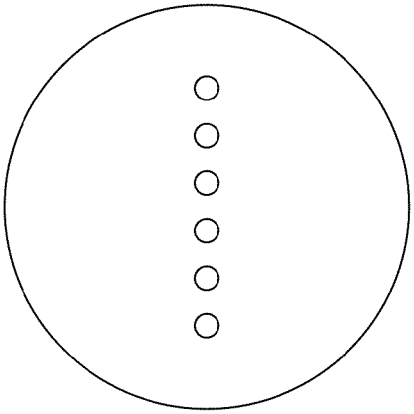
FIGS. 3A-3E are cross-sectional views of multi-bore capillaries of a mass spectrometer, according to representative embodiments.
Figure 3B:
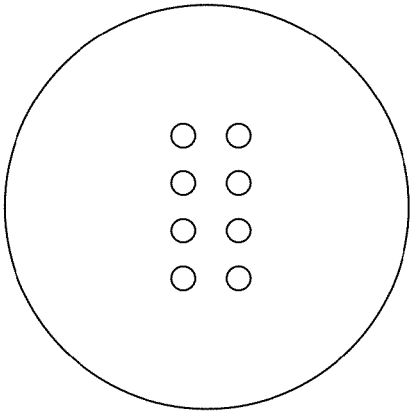
Figure 3C:
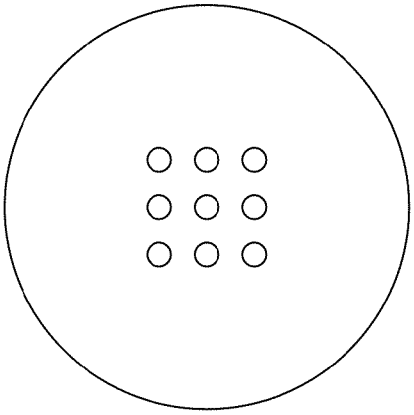

FIG. 3A depicts a representative cross-sectional configuration in which the multiple capillary bores are arranged in a single line. In particular, FIG. 3A depicts six capillary bores arranged in a vertical line. The capillary bores are spaced equally apart and have the same diameter. FIGS. 3B and 3C depict representative cross-sectional configurations in which the multiple capillary bores are arranged in equally spaced rows and columns. In particular, FIG. 3B depicts eight capillary bores arranged in two parallel vertical lines of four capillary bores each (i.e., four rows and two columns), and FIG. 3C depicts nine capillary bores are arranged in three parallel vertical lines of three capillary bores each (i.e., three rows and three columns).

Figure 3D:
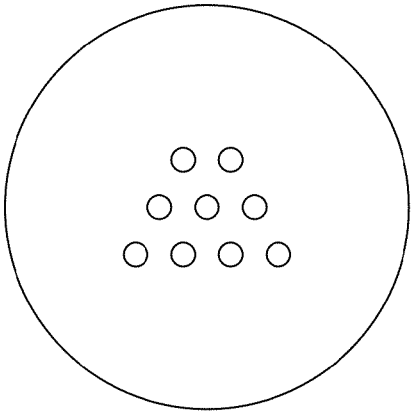

FIG. 3D depicts a representative cross-sectional configuration in which the multiple capillary bores are arranged in a staggered fashion with respect to one another. In particular, FIG. 3D depicts nine capillary bores arranged in three parallel horizontal lines. The bottom line includes four equally spaced capillary bores, the middle line includes three equally spaced capillary bores positioned above the spaces between the capillary bores in the bottom line, and the top line includes two capillary bores positioned above the spaces between the capillary bores in the middle line.

Figure 3E:
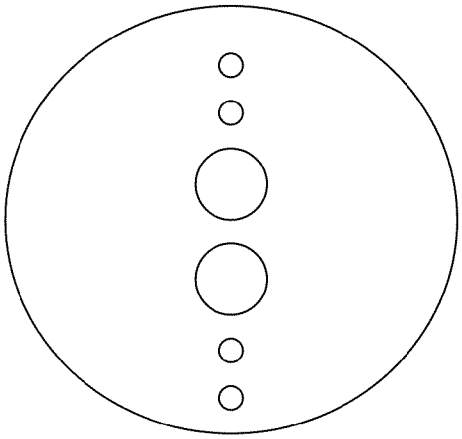

FIG. 3E depicts a representative cross-sectional configuration in which the capillary bores have different diameters. More particularly, FIG. 3E depicts six capillary bores arranged in a vertical line, similar to the six capillary bores of FIG. 3A. However, in FIG. 3E, the inner two capillary bores have the same diameter as one another, and the outer four capillary bores have the same diameter as one another. The diameter of each of the inner two capillary bores is greater than the diameter of each of the outer four capillary bores.

As stated above, the cross-sectional configuration of the capillary bores, including the representative cross-sectional configurations shown in FIGS. 3A-3E, may be selected to provide unique benefits for particular situations or to meet application specific design requirements, as would be apparent to one skilled in the art. For example, the single line configuration of six capillary bores shown in FIGS. 3A and 3E may be used for a particularly narrow or concentrated vapor plume distribution output by the ion source 110 substantially along the single line, while the broader centralized configurations of nine capillary bores shown in FIGS. 3C and 3D may be used for a more uniform vapor plume distribution output by the ion source 110.

It is understood that relational terms used herein, such as "vertical," "horizontal," "top," "bottom," "row," "column," "above" and "below," are intended to describe conveniently the various elements in relation to one another, and are not limiting. In other words, the description addresses positional relationships among the various elements, which are applicable regardless of changes in orientation. For example, if the capillary cross-section depicted in FIG. 3A were rotated 90 degrees, the vertical line of equally spaced capillary bores would become a horizontal line of equally spaced capillary bores, without departing from the scope of the present teachings.

Figure 4:
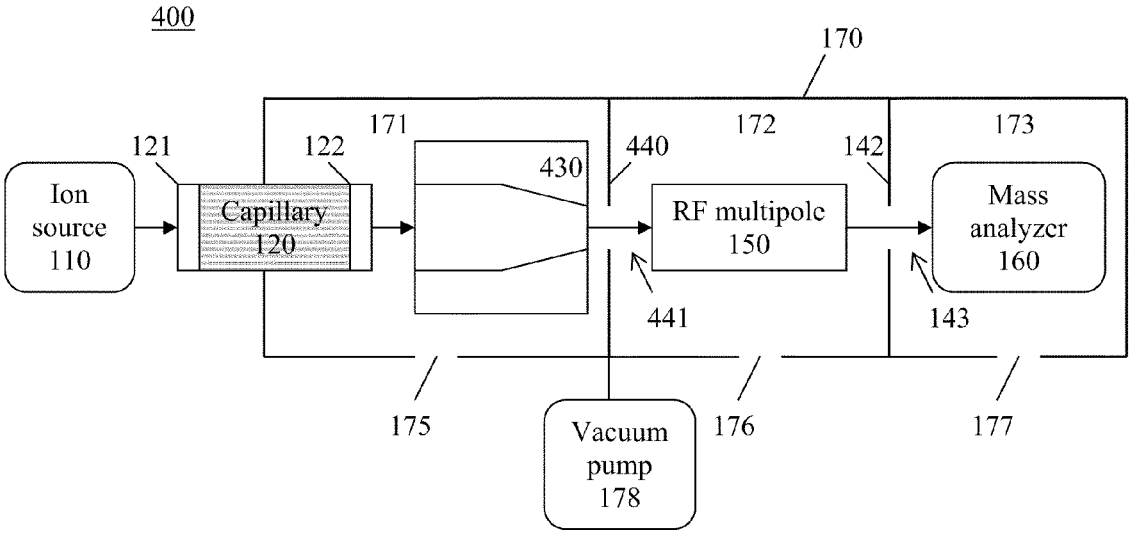
FIG. 4 is a block diagram illustrating mass spectrometer including a multi-bore capillary and ion funnel, according to a representative embodiment.

FIG. 4 is a block diagram illustrating mass spectrometer system including a multi-bore capillary and ion funnel, according to another representative embodiment.

Referring to FIG. 4, mass spectrometer 400 includes ion source 110, multi-bore capillary 120, ion funnel(s) 430, conductance 440, RF multipole 150 and mass analyzer 160. As discussed above with reference to FIG. 1, the ion source 110 generates a vapor plume containing ions from a sample provided by a liquid or gas chromatograph device (not shown). The capillary 120 includes multiple bores (i.e., two or more), through which ions from the vapor plume are drawn for detection and analysis by the RF multipole 150 and/or the mass analyzer 160. In an embodiment, the capillary 120 may also include conductive end portions 121 and 122 for applying a difference in electrical potential across the input and output ends of the capillary 120.

The mass spectrometer 400 includes the ion funnel 430 and the conductance 440 in place of the ion focusing optics 130 and the skimmer 140 of the mass spectrometer 100, discussed above. The other components are substantially the same as the corresponding components of the mass spectrometer 100, and therefore the respective descriptions will not be repeated.

The ion funnel 430 represents one or more ion funnels, in tandem, positioned between an output end of the multi-bore capillary 120 and the conductance 440. Generally, the ion funnel 430 is able to accommodate larger ion flows than the skimmer 140. The ion funnel 430 includes a stack of electrically driven plates, as described, for example, in U.S. Pat. No. 6,107,628 (Smith et al.), issued Aug. 22, 2000, the subject matter of which is hereby incorporated by reference. The ion funnel 430 directs or transports the beam of ions from the capillary 120 to the orifice 441 of the conductance 440 to further improve transfer efficiency of the ions. The orifice 441 of the conductance 440 passes a center core of ions to the RF multipole 150, after which the ions pass through orifice 143 of partition 142 to the mass analyzer 160 for detection.

The conductance 440 serves as a barrier between the first vacuum region 171 and the second vacuum region 172, which are respectively pumped through first port 175 and second port 176 by representative high vacuum pump 178, keeping the pressure in the second vacuum chamber 172 lower than the pressure in the first vacuum chamber 171, as discussed above. The conductance 440 is formed from a thin metal plate, and includes the orifice 441, which is typically about 2 mm in diameter, for example.

Accordingly, in the depicted embodiment, the mass spectrometer 400 may be an LCMS and the ion source 110 may be an ESI source, for example, which generates a vapor plume of ions from samples input by a liquid chromatograph device (not shown). The vapor plume is directed past the input end of the multi-bore capillary 120, typically along a path orthogonal to the direction of the flow through the multiple capillary bores. Ions of the vapor plume are drawn through the capillary 120, based on pressure differential. The ion flow to the RF multipole 150 and the mass analyzer 160 is further enhanced by the ion funnel 430, the conductance 440 and the partition 142.

Figure 5:
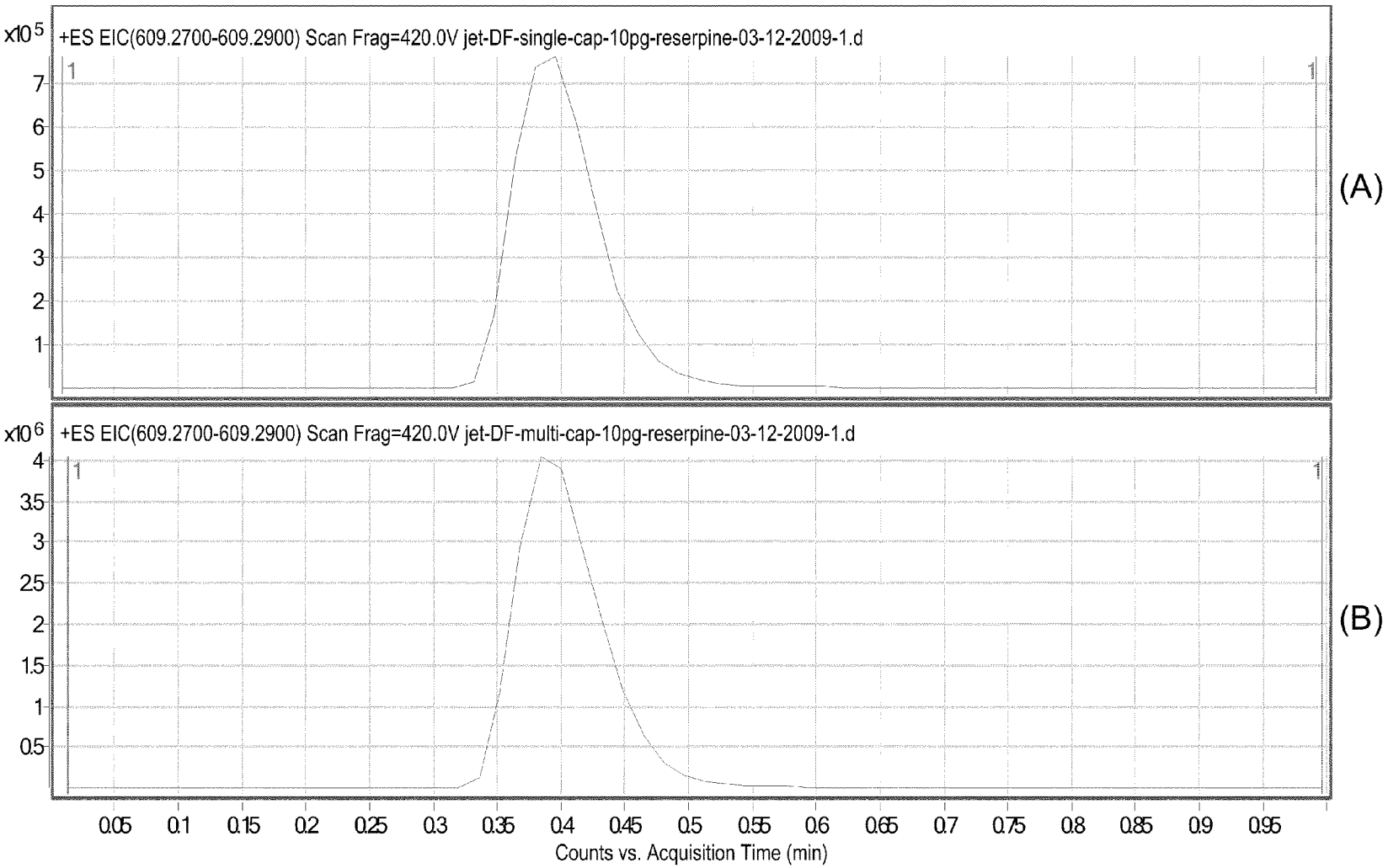
FIGS. 5A-5B are chromatogram spectrums comparing detection sensitivity of mass spectrometers using a single bore capillary versus a multi-bore capillary, according to a representative embodiment.

FIGS. 5A-5B are chromatogram spectrums comparing detection sensitivity of mass spectrometers using single bore capillary versus a multi-bore capillary, according to a representative embodiment.

More particularly, FIG. 5A shows a chromatogram of a 10 pg sample of Reserpine, obtained using a mass spectrometer including a single bore capillary. In comparison, FIG. 5B shows a chromatogram of a 10 pg sample of Reserpine using a multi-bore capillary, such as multi-bore capillary 220 of FIG. 2, according to a representative embodiment. As shown, the sensitivity indicated by the peak of the chromatogram of FIG. 5B (about $4\times10^6$ counts) shows about a 5.5 times increase in sensitivity over the sensitivity indicated by the peak of the chromatogram of FIG. 5A (about $7\times10^5$ counts).

While specific embodiments are disclosed herein, many variations are possible, which remain within the concept and scope of the invention. Such variations would become clear after inspection of the specification, drawings and claims herein. The invention therefore is not to be restricted except within the scope of the appended claims.

What is claimed is:

1. A mass spectrometer system, comprising:

an ion source configured to produce ions; and a capillary formed of a non-metallic material and configured to receive at least a portion of the ions from the ion source, the capillary comprising an elongated body and a plurality of bores formed through the non-metallic material, traversing the elongated body in a longitudinal direction from the ion source to a vacuum chamber of the mass spectrometer system, the plurality of bores transporting the received ions through the capillary toward a mass analyzer for detection.

2. The system of claim 1, wherein the plurality of bores have substantially tubular shapes with corresponding longitudinal axes that are substantially parallel with one another.

3. The system of claim 2, wherein the body of the capillary has a length in the longitudinal direction of less than about 20 cm and each of the plurality of bores has an inner diameter of no greater than about 0.9 mm.

4. The system of claim 2, wherein the plurality of bores include a center bore and at least two outer bores symmetrically arranged on opposite sides of the center bore.

5. The system of claim 4, wherein the center bore has a larger inner diameter than the at least two outer bores.

6. The system of claim 1, wherein the ion source outputs a vapor comprising the produced ions, an input end of the capillary being exposed to the ion vapor to receive the at least a portion of the ions.

7. The system of claim 1, wherein the non-metallic material of the capillary comprises insulating glass.

8. The system of claim 1, wherein the non-metallic material of the capillary comprises resistive glass.

9. The system of claim 1, wherein the capillary further comprises metal end portions on input and output ends of the capillary, and wherein voltages having opposite polarities are applied to the metal end portions, respectively, to create a difference in electrical potential across the capillary in the longitudinal direction, the difference in electrical potential providing a change of potential energy of the received ions when they exit from the plurality of bores.

10. The system of claim 9, wherein the polarities of the voltages applied to the metal end portions are rapidly switched.

11. The system of claim 9, wherein the input end is adjacent to the ion source and the output end is opposite the input end, wherein a pressure at the input end is substantially greater than a pressure at the output end, creating a pressure differential, the pressure differential drawing the received ions through the plurality of bores.

12. The system of claim 11, further comprising:

a skimmer positioned between the output end of the capillary and the mass analyzer, the skimmer being configured to select a center core of the ions transported through the capillary to be directed to the mass analyzer.

13. The system of claim 11, further comprising:

one or more ion funnels positioned between the output end of the capillary and the mass analyzer, the ion funnels being configured to transport at least a portion of the ions transported through the capillary to be directed to the mass analyzer.

14. A mass spectrometer system comprising:

an ion source configured to output ions from an input sample, the ions being contained in an ion vapor;

a capillary comprising an elongated glass body having first and second opposing ends and a plurality of bores formed through the elongated glass body in a longitudinal direction between the first and second ends, and first and second metal portions respectively attached to the first and second ends of the capillary for creating a difference of electrical potential across the capillary, the first end of the capillary being exposed to the ion vapor for receiving at least a portion of the ions and the second end of the capillary being contained in a vacuum chamber of the mass spectrometer system, the received ions being transported through the plurality of bores of the capillary and output from the second end; and a mass analyzer in the vacuum chamber configured to receive and detect the ions output from the second end of the capillary.

15. The system of claim 14, wherein the plurality of bores have corresponding longitudinal axes that are substantially parallel with one another.

16. The system of claim 14, wherein for negative ions, positive and negative voltages are respectively applied to the first and second metal portions to create an electrical polarity comprising a positive pole at the first end and a negative pole, relative to the first end, at the second end, the received negative ions having a change in potential energy while being transported through the plurality of bores of the capillary.

17. The system of claim 14, wherein for positive ions, negative and positive voltages are respectively applied to the first and second metal portions to create an electrical polarity comprising a negative pole at the first end and a positive pole, relative to the first end, at the second end, the received positive ions having a change in potential energy while being transported through the plurality of bores of the capillary.

18. The system of claim 14, wherein the glass body comprises resistive glass, and the electrical polarity across the first and second ends of the capillary are rapidly switched.

19. A capillary device positioned between an ion source and a mass analyzer in a vacuum chamber of a mass spectrometer system, the capillary device comprising:

a substantially tubular body formed of a non-metallic material, the tubular body having a first end facing the ion source, a second end contained in the vacuum chamber facing the mass analyzer, and a longitudinal axis extending a length of the tubular body;

a plurality of substantially tubular bores through the non-metallic material, traversing the length of the tubular body, each of the plurality of bores having a corresponding longitudinal bore axis that is substantially parallel to the longitudinal axis of the tubular body, ions produced by the ion source passing through the plurality of tubular bores to be received by the mass analyzer; and first and second metal end portions respectively attached to the first and second ends of the capillary for creating an electrical polarity across the capillary, wherein the first and second metal end portions are configured for rapid switching of the electrical polarity, enabling rapid voltage reversal across the capillary to provide alternating data collection between positive and negative ions of the ions produced by the ion source.

20. The device of claim 19 wherein the rapid switching of the electrical polarity occurs at a rate of about 5 times per second to about 10 times per second.

* * * * *